US008772215B2

(12) United States Patent
Ryther et al.

(10) Patent No.: US 8,772,215 B2
(45) **Date of Patent: *Jul. 8, 2014**

(54) HIGH ALKALINE SOLVENT-BASED CLEANERS, CLEANING SYSTEMS AND METHODS OF USE FOR CLEANING ZERO TRANS FAT SOILS

(75) Inventors: Robert J. Ryther, St. Paul, MN (US); Walter D. Cummings, Farmington, MN (US)

(73) Assignee: Ecolab USA Inc., St. Paul, MN (US)

( * ) Notice: Subject to any disclaimer, the term of this patent is extended or adjusted under 35 U.S.C. 154(b) by 47 days.

This patent is subject to a terminal disclaimer.

(21) Appl. No.: 12/816,050

(22) Filed: Jun. 15, 2010

(65) Prior Publication Data

US 2010/0317560 A1 Dec. 16, 2010

Related U.S. Application Data

(60) Provisional application No. 61/187,236, filed on Jun. 15, 2009.

(51) Int. Cl.
*C11D 3/43* (2006.01)

(52) U.S. Cl.
USPC ..... 510/218; 510/235; 510/245; 510/252

(58) Field of Classification Search
USPC ..... 510/218, 235, 245, 252
See application file for complete search history.

(56) References Cited

U.S. PATENT DOCUMENTS

| | | | | |
|---|---|---|---|---|
| 5,811,383 | A * | 9/1998 | Klier et al. | 510/417 |
| 5,877,142 | A * | 3/1999 | Gross et al. | 510/421 |
| 5,929,007 | A | 7/1999 | Feng | |
| 7,098,178 | B2 * | 8/2006 | Gerke et al. | 510/466 |
| 7,838,484 | B2 * | 11/2010 | Underwood et al. | 510/197 |
| 2003/0119705 | A1 | 6/2003 | Barnabas et al. | |
| 2003/0143909 | A1 | 7/2003 | Barnabas et al. | |
| 2004/0072704 | A1 * | 4/2004 | Gerke et al. | 510/101 |
| 2004/0138084 | A1 | 7/2004 | Gohl et al. | |
| 2006/0035808 | A1 * | 2/2006 | Ahmed et al. | 510/499 |
| 2006/0079433 | A1 * | 4/2006 | Hecht et al. | 510/424 |
| 2006/0257281 | A1 * | 11/2006 | Weide et al. | 422/6 |

FOREIGN PATENT DOCUMENTS

| | | | |
|---|---|---|---|
| EP | 879226 | B1 | 8/2001 |
| EP | 919612 | B1 | 10/2001 |
| EP | 981597 | | 1/2002 |
| EP | 1583813 | B1 | 1/2004 |
| JP | 2004-536198 | | 12/2004 |
| WO | WO02-08374 | | 1/2002 |
| WO | WO03/044151 | | 5/2003 |
| WO | WO2008-008063 | | 1/2008 |

* cited by examiner

*Primary Examiner* — Nicole M Buie-Hatcher
*Assistant Examiner* — M. Reza Asdjodi
(74) *Attorney, Agent, or Firm* — Amy J. Hoffman

(57) ABSTRACT

The present invention relates to high alkaline-solvent cleaners, cleaning systems and methods for removing polymerized zero trans fat soils. The high alkaline-solvent cleaner of the present invention generally includes one or more soil wetting and cleaning solvent(s) and one or more alkaline wetting and saponifying agent(s) that wets and saponifies the soil. In various embodiments, the cleaners may include, at least one cleaning agent comprising a surfactant or surfactant system and/or a at least one chelating/sequestering/threshold agent. In some embodiments, the cleaners may include one or more components to modify the composition form and/or the application method. All components described above can also be optimized optionally, to provide emulsification of a composition (both as a usable product or a concentrate that can be diluted to form a usable product). The use of the high alkaline-solvent cleaner of the present invention has demonstrated enhanced cleaning characteristics especially at ambient temperatures and showing increased cleaning with increased temperatures in comparison to other conventional cleaning techniques.

11 Claims, No Drawings

HIGH ALKALINE SOLVENT-BASED CLEANERS, CLEANING SYSTEMS AND METHODS OF USE FOR CLEANING ZERO TRANS FAT SOILS

CROSS REFERENCE TO RELATED U.S. APPLICATIONS

This patent application claims the priority benefit from U.S. Provisional Application No. 61/187,236, filed on Jun. 15, 2009, incorporated herein by reference.

FIELD OF THE INVENTION

The present disclosure relates to high alkaline-solvent cleaners, cleaning systems and methods for removing polymerized zero trans fat soils. The high alkaline-solvent cleaner of the present invention generally includes one or more soil wetting and cleaning solvent(s) and one or more alkaline agent(s) that wets and saponifies the soil. In various embodiments of the present invention, the cleaners may include, at least one cleaning agent comprising a surfactant or surfactant system and/or a at least one chelating/sequestering/threshold agent. In additional embodiments of the present invention, the cleaners may include one or more components to modify the composition form and/or the application method. All components described above can also be optimized optionally, to provide emulsification of a composition (both as a usable product or a concentrate that can be diluted to form a usable product). The use of the high alkaline-solvent cleaner of the present invention has demonstrated enhanced cleaning characteristics especially at ambient temperatures but showing increased cleaning with increased temperatures as well compared to other conventional cleaning techniques.

BACKGROUND

Health authorities have recently recommended that trans fats be reduced in diets because they present health risks. In response, the food industry has largely replaced the use of trans fats with zero trans fats. Trans fats being defined as unsaturated fat with trans-isomer fatty acid(s). Food products with zero trans fat is defined by the United States Food and Drug Administration in the regulation 21 CFR 101.9 (c)(2)(ii) to "contain less than 0.5 gram of total fat in a serving" and that "trans fat content information is not required for products that contain less than 0.5 gram of total fat in a serving" and "if the serving contains less than 0.5 gram, the content, when declared, shall be expressed as zero." Manufacturers desiring a level of fat in food products higher than the 0.5 gram (adjusted for the level of trans fat in a given fat used in the food product) per serving are required to use fats with low trans fat content or zero trans fats. (Fats defined as zero trans fats by those skilled in the art will generally, by the nature of the processing required for these fats, contain relatively small amounts of trans fats.) While the use of zero trans fats in food products is good for consumers, it is problematic for the food industry, because food processing equipment and/or environmental surfaces become contaminated with polymerized zero trans fats soils, which are very difficult to clean. Zero trans fats are less stable and more prone to degradation and polymerization than trans fats or saturated fats. Zero trans fats can be left on ambient or cold surfaces for an extended period of time and polymerize on these surfaces creating a difficult to clean soil. The longer a zero trans fats soil is left to polymerize on a surface, the more difficult it becomes to remove the soil from that surface. Mists of zero trans fats emanating from a hot zero trans fat source can also collect onto various surfaces and polymerize over time on these surfaces. The surfaces collecting these mists can be at cold, hot or ambient temperatures and create difficult to clean soils on all of these surfaces. Zero trans fats can be burnt onto cooking surfaces and then polymerize over time at an increased rate compared to a surface at a lower temperature and create soils that are more difficult to remove than trans fat or saturated fat based soils. In addition, other food materials such as proteins, carbohydrates and other fats can be mixed in with the zero trans fats which, as they polymerize can also create complicated, hard to remove soils and residues.

Those employing frying and baking operations are particularly affected by zero trans fats soils, because they use zero trans fats in high volumes. Also, these operations commonly route zero trans fats through tanks, lines, pumps and other processing equipment, which must be periodically cleaned but can in some operations go a significant amount of time between cleanings as required by the specific production process. In addition, other equipment, especially high, out of place piping, duct work (external as well as internal), roofs and ceilings, heating, cooling and air conditioning surfaces (HVAC), product freezers and coolers and many other surfaces in food manufacturing sites, can sometimes be left for days, weeks or months without thorough cleaning, collecting zero trans fat contamination and forming extremely hard to remove, polymerized zero trans fat soils. These soils can be so difficult to remove that in some cases, it would be less expensive to replace equipment than to pay for the intensive labor required to clean properly. In order to permit food production operations to continue without major changes to equipment and food processing facility designs, a new method of cleaning is needed to permit extended food production time and to retain a safe, clean food processing environment.

Therefore, it would be desirable to provide a cleaning composition that can disrupt the structure of polymerized zero trans fats soils to adequately remove this type of soil and thereby clean surfaces. It would also be desirable to provide cleaning systems and methods to remove polymerized zero trans fats soils, particularly soils that are on hard to access equipment.

SUMMARY OF THE INVENTION

In one embodiment, the present invention is a method of cleaning polymerized zero trans fat soils from soiled surfaces using a high alkaline-solvent composition including one or more soil wetting and cleaning solvent(s) and one or more alkaline agent(s) that wets and saponifies the soil. The method includes forming a composition and contacting a soiled surface with the composition.

In another embodiment, the present invention is a high-alkaline-solvent composition including between about 0.1% and about 50% by weight one or more soil wetting and cleaning solvent(s) and between about 0.1% and about 75% by weight one or more alkaline agent(s) that wets and saponifies the soil. The composition may include between about 0.1% to about 40% by weight one or more cleaning agent(s) and between about 0.01% to about 5% by weight one or more additive(s) to modify the composition form and/or the application method wherein the composition is applied to a soiled surface at a temperature of between about 33 degrees Fahrenheit up to about 200 degrees Fahrenheit. Moreover, the composition may be emulsified at a usable cleaning solution concentration or in a concentrated form that may be diluted to a usable cleaning solution concentration.

While multiple embodiments are disclosed, still other embodiments of the present invention will become apparent to those skilled in the art from the following detailed description, which shows and describes illustrative embodiments of the invention. Accordingly, the detailed description is to be regarded as illustrative in nature and not restrictive.

DETAILED DESCRIPTION

The present invention relates to high alkaline-solvent cleaning compositions, cleaning systems and cleaning methods for removing polymerized zero trans fat soils from a soiled surface which are more difficult to clean than surfaces with trans fat soils.

So that the invention may be more readily understood, certain terms are first defined.

As used herein, "weight percent," "wt-%," "percent by weight," "% by weight," and variations thereof refer to the concentration of a substance as the weight of that substance divided by the total weight of the composition and multiplied by 100. It is understood that, as used here, "percent," "%," and the like are intended to be synonymous with "weight percent," "wt-%," etc.

As used herein, the term "about" refers to variation in the numerical quantity that can occur, for example, through typical measuring and liquid handling procedures used for making concentrates or use solutions in the real world; through inadvertent error in these procedures; through differences in the manufacture, source, or purity of the ingredients used to make the compositions or carry out the methods; and the like. The term "about" also encompasses amounts that differ due to different equilibrium conditions for a composition resulting from a particular initial mixture. Whether or not modified by the term "about", the claims include equivalents to the quantities.

It should be noted that, as used in this specification and the appended claims, the singular forms "a," "an," and "the" include plural referents unless the content clearly dictates otherwise. Thus, for example, reference to a composition containing "a compound" includes a composition having two or more compounds. It should also be noted that the term "or" is generally employed in its sense including "and/or" unless the content clearly dictates otherwise.

As used herein, the term "cleaning" refers to a method used to facilitate or aid in soil removal, bleaching, microbial population reduction, and any combination thereof.

High-Alkaline Solvent Composition

The present invention relates to high alkaline-solvent compositions that clean polymerized zero trans fat soils. In many embodiments of the present invention, the high alkaline-solvent compositions are beneficial in cleaning soiled surfaces, wherein the soils are composed of or contain polymerized zero trans fats. Generally, the high alkaline-solvent composition includes: between about 0.1% to about 50% by weight one or more soil wetting solvent(s) and between about 0.1% to about 75% by weight one or more alkaline wetting and saponifying agent(s) that wets and saponifies the soil. In various embodiments of the present invention, the composition may include between about 0.1% to about 40% by weight one or more cleaning agent(s) comprising a surfactant or surfactant system and/or between about 0.01% to about 5% by weight one or more additives to modify the composition form and/or the application method. All components described above can also be optimized optionally, to provide emulsification of a composition (both as a usable product or a concentrate that can be diluted to form a usable product). Moreover, the high alkaline-solvent composition has the ability to react with and dissolve polymerized zero trans fat soils at ambient temperatures as well as at higher temperatures and permit cleaning of surfaces contaminated with these difficult to remove soils.

Soil Wetting Solvent System

The high alkaline-solvent composition of the present invention includes between about 0.1% to about 50% by weight one or more soil wetting solvent(s). The soil wetting solvent(s) permits wetting of the zero trans fat soil and works in conjunction with the alkaline wetting and saponifying agent(s) in the high alkaline-solvent composition to break down the polymerized zero trans fat soil especially at ambient temperatures. The soil wetting solvent system may also be used to provide emulsifying properties of a given composition (to keep hydrophilic and hydrophobic components of the specific composition from separating) if required for a polymerized zero trans fat soil cleaning method. The emulsifying properties can be used for both a concentrate that can be diluted to create a usable cleaning product (use dilution) and the use dilution itself.

Representative solvent systems generally comprise one or more different solvents including aromatic alcohols (e.g., benzyl alcohols, phenyl alcohols), alkanol amines, ether amines, esters (e.g., cyclic esters, dibasic esters and phthalate esters, methyl esters, butyl esters . . . ) and mixtures thereof. Representative solvents include acetamidophenol, acetanilide, acetophenone, 2-acetyl-1-methylpyrrole, benzyl acetate, benzyl alcohol, methyl benzyl alcohol, alpha phenyl ethanol, benzyl benzoate, benzyloxyethanol, ethylene glycol phenyl ether (commercially available as "DOWANOL EPh" from Dow Chemical Co.), propylene glycol phenyl ether (commercially available as "DOWANOL PPh" from Dow Chemical Co.), amyl acetate, amyl alcohol, butanol, 3-butoxyethyl-2-propanol, butyl acetate, n-butyl propionate, cyclohexanone, diacetone alcohol, diethoxyethanol, diethylene glycol methyl ether, diisobutyl carbinol, diisobutyl ketone, dimethyl heptanol, dipropylene glycol tert-butyl ether, ethanol, ethyl acetate, 2-ethylhexanol, ethyl propionate, ethylene glycol methyl ether acetate, hexanol, isobutanol, isobutyl acetate, isobutyl heptyl ketone, isophorone, isopropanol, isopropyl acetate, methanol, methyl amyl alcohol, methyl n-amyl ketone, 2-methyl-1-butanol, methyl ethyl ketone, methyl isobutyl ketone, 1-pentanol, n-pentyl propionate, 1-propanol, n-propyl acetate, n-propyl propionate, propylene glycol ethyl ether, tripropylene glycol methyl ether (commercially available as DOWANOL TPM from Dow Chemical Co.), tripropylene glycol n-butyl ether (commercially available as DOWANOL TPNB from Dow Chemical Co.), diethylene glycol n-butyl ether acetate (commercially available as Butyl CARBITOL™ acetate from Dow Chemical Co.), diethylene glycol monobutyl ether (commercially available as Butyl CARBITOL from Dow Chemical Co.), ethylene glycol n-butyl ether acetate (commercially available as Butyl CELLOSOLVE™ acetate from Dow Chemical Co.), ethylene glycol monobutyl ether (commercially available as Butyl CELLOSOLVE from Dow Chemical Co.), dipropylene glycol monobutyl ether (commercially available as Butyl DIPROPASOL™ from Dow Chemical Co.), propylene glycol monobutyl ether (commercially available as Butyl PROPASOL from Dow Chemical Co.), ethyl 3-ethoxypropionate (commercially available as UCAR™ Ester EEP from Dow Chemical Co.), 2,2,4-Trimethyl-1,3-Pentanediol Monoisobutyrate (commercially available as UCAR Filmer IBT from Dow Chemical Co.), diethylene glycol monohexyl ether (commercially available as Hexyl CARBITOL from Dow Chemical Co.), ethylene glycol monohexyl ether (commercially available as Hexyl CELLOSOLVE from Dow Chemical Co.), diethylene glycol monomethyl ether (commercially available as Methyl CARBITOL from Dow Chemical Co.), diethylene glycol monoethyl ether (commercially available as CARBITOL from Dow Chemical Co.), ethylene glycol methyl ether acetate (commercially available as Methyl CELLOSOLVE acetate from Dow Chemical Co.), ethylene glycol monomethyl ether (commercially available as Methyl CELLOSOLVE from Dow Chemical Co.), dipropylene glycol monomethyl ether (commercially available as Methyl DIPROPASOL from Dow Chemical Co.), propylene glycol methyl ether acetate (commercially available as Methyl PROPASOL™ acetate from Dow Chemical Co.), propylene glycol monomethyl ether (commercially available as Methyl PROPASOL from Dow Chemical Co.), diethylene glycol monopropyl ether (commercially available as Propyl CARBITOL from Dow Chemical Co.), ethylene glycol monopropyl ether (commercially available as Propyl CELLOSOLVE from Dow Chemical Co.), dipropylene glycol monopropyl ether (commercially available as Propyl DIPROPASOL from Dow Chemical Co.) and propylene glycol monopropyl ether (commercially available as Propyl PROPASOL from Dow Chemical Co.). Representative dialkyl carbonates include dimethyl carbonate, diethyl carbonate, dipropyl carbonate, diisopropyl carbonate and dibutyl carbonate. Representative oils include benzaldehyde, pinenes (alphas, betas, etc.), terpineols, terpinenes, carvone, cinnamealdehyde, borneol and its esters, citrals, ionenes, jasmine oil, limonene, dipentene, linalool and its esters. Representative dibasic esters include dimethyl adipate, dimethyl succinate, dimethyl glutarate, dimethyl malonate, diethyl adipate, diethyl succinate, diethyl glutarate, dibutyl succinate, dibutyl glutarate and products available under the trade designations DBE™, DBE-3, DBE-4, DBE-5, DBE-6, DBE-9, DBE-IB, and DBE-ME from DuPont Nylon. Representative phthalate esters include dibutyl phthalate, diethylhexyl phthalate and diethyl phthalate. Preferred solvents for wetting of polymerized non-trans fat soils include benzyl alcohol, dibasic esters, essential oils, dialkyl carbonates, ethylene glycol monobutyl ether, diethylene glycol monobutyl ether, ethylene glycol phenyl ether, propylene glycol phenyl ether and mixtures thereof. Representative alkanol amines include 2-(2-aminoethoxy)ethanol, monoethanolamine, diethanolamine, triethanolamine, mixed isopropanolamines, morpholine, n,n-dimethyl ethanolamine and mixtures thereof.

In some embodiments, the amount of solvent(s) present in the composition is about 1 wt % to about 50 wt %. In other embodiments, the amount of solvent(s) present in the composition is about 5 wt % to about 40 wt %. In still other embodiments, the amount of solvent(s) present in the composition is about 10 wt % to about 30 wt %.

Alkaline Wetting and Saponifying Agent(s)

The high alkaline-solvent composition of the present invention includes between about 0.1% to about 75% by weight one or more alkaline wetting and saponifying agent(s). The removal of polymerized zero trans fat soils must be initiated and sustained by the penetration and disruption of these fats from the upper soil surface all the way to the substrate surface being cleaned. The alkaline component of this composition works in conjunction with the soil wetting solvents of the composition to penetrate the soils and break down the polymerized zero trans fat soil molecules and/or the substrate surface to be cleaned. While the alkaline component can be effective alone, without the soil wetting solvent system, in wetting and breaking down these soils, the efficacy of such an alkaline only system is very limited at ambient conditions and requires higher temperatures to show any significant soil removal effects. Not to be bound by theory but it is conjectured that the cations of the alkaline wetting agent(s) (e.g. $Na^{2+}$, $K^{2+}$ . . . ) in the compositions have a tendency to react with the negatively charged fatty acids that are part of the zero trans fats. Such reaction saponifies the fats and forms salts (e.g. sodium or potassium salts) thereby breaking down and/or disrupting the fats that may have already become polymerized. The saponifying of the fats allows the other components of the high alkaline-solvent composition to interact with the soils to perform the desired cleaning function. It is noted that the wetting and saponifying agent(s) in combination with the other components provide a relatively high alkalinity. In many embodiments of the present invention the pH of the cleaner is about 11 or greater. In other embodiments of the present invention the pH of the cleaning composition is about 12 or greater. In still other embodiments of the present invention the pH of the cleaning composition is about 13 or greater.

In some embodiments, the source of alkalinity comprises an alkali or alkaline earth metal hydroxide, for example, sodium hydroxide (NaOH), lithium hydroxide, calcium hydroxide, and/or potassium hydroxide (KOH). Other alkalinity sources suitable for use in the compositions and methods of the present invention include, but are not limited to, silicate salts, amines, alkanol amines, phosphate salts, polyphosphate salts, carbonate salts, borate salts, and combinations thereof. For example, the source of alkalinity can comprise sodium silicate, sodium metasilicate, sodium orthosilicate, sodium phosphate, sodium polyphosphate, sodium borate, sodium carbonate, potassium silicate, potassium metasilicate, potassium orthosilicate, potassium phosphate, potassium polyphosphate, potassium borate, potassium carbonate, lithium silicate, lithium metasilicate, lithium orthosilicate, lithium phosphate, lithium polyphosphate, lithium borate, lithium carbonate, 2-(2-aminoethoxy)ethanol, monoethanolamine, diethanolamine, triethanolamine, mixed isopropanolamines, morpholine, n,n-dimethyl ethanolamine and combinations thereof.

In some embodiments, the cleaning compositions of the present invention comprise about 0.1 wt % to about 75 wt % of a source of alkalinity. In some embodiments, the source of alkalinity is present at about 1 wt % to about 40 wt % of the cleaning composition. In still yet other embodiments, the cleaning compositions comprise about 1.5% to about 30 wt % of a source of alkalinity. It is to be understood that all values and ranges between these values and ranges are encompassed by the present invention.

Cleaning Agent(s)—Surfactant or Surfactant System

In some embodiments of the present invention, the high alkaline-solvent composition may include between about 0.1% to about 40% by weight of at least one cleaning agent comprising a surfactant or surfactant system. The surfactant or surfactant system is used to help emulsify the zero trans fat soil in the high alkaline cleaning solution and must be stable to decompose in an alkaline media during the cleaning cycle as well as work in conjunction with the alkaline fatty acid soaps that are formed naturally as a result the breaking down of zero trans fats in alkaline media. The cleaning agent can also be used, optionally, to provide emulsifying properties of a given composition (to keep hydrophilic and hydrophobic components of the specific composition from separating) if required for a polymerized zero trans fat soil cleaning method. The emulsifying properties can be used for both a concentrate that can be diluted to create a usable cleaning product (use dilution) and the use dilution itself. The surfactant or mixture of surfactants can have foaming or defoaming characteristics in the composition as required by a desired cleaning method. For example, in certain applications a long lasting foam may be required which can extend the cleaning time on a surface for the compositions. While in other applications it may be desirable to minimize foaming and a surfactant or mixture of surfactants that provide reduced foaming may be used. In addition, it may be desirable to select a surfactant or a mixture of surfactants that exhibits a foam that breaks down relatively quickly so that the composition can be recovered and reused with an acceptable amount of down time. The surfactant or mixture of surfactants can be selected depending upon the particular polymerized zero trans fat soil that is to be removed. Surfactants that can be used in the system include anionic, nonionic, cationic, and zwitterionic surfactants, which are commercially available from a number of sources. Suitable surfactants include nonionic surfactants, for example, low foaming nonionic surfactants. For a discussion of surfactants, see Kirk-Othmer, *Encyclopedia of Chemical Technology*, Third Edition, volume 8, pages 900-912.

It should be understood that surfactants are an optional component of the compositions and can be included in the compositions of the present invention or excluded from the compositions.

In some embodiments, the cleaning compositions of the present invention comprise about 0.1 wt % to about 40 wt % of a surfactant or surfactant system as a cleaning agent. In some embodiments, the cleaning agent is present in the composition at about 0.2 wt % to about 15 wt %. In still yet other embodiments, the cleaning agent is present in the compositions at about 0.5% to about 10 wt %. It is to be understood that all values and ranges between these values and ranges are encompassed by the present invention.

Suitable nonionic surfactants include, but are not limited to, those having a polyalkylene oxide polymer as a portion of the surfactant molecule. Exemplary nonionic surfactants include, but are not limited to, chlorine-, benzyl-, methyl-, ethyl-, propyl-, butyl- and other like alkyl-capped polyethylene and/or polypropylene glycol ethers of fatty alcohols; polyalkylene oxide free nonionics such as alkyl polyglycosides; sorbitan and sucrose esters and their ethoxylates; alkoxylated ethylene diamine; carboxylic acid esters such as glycerol esters, polyoxyethylene esters, ethoxylated and glycol esters of fatty acids; carboxylic amides such as diethanolamine condensates, monoalkanolamine condensates, polyoxyethylene fatty acid amides; and ethoxylated amines and ether amines commercially available from Tomah Corporation and other like nonionic compounds. Silicone surfactants such as the ABIL B8852 (Goldschmidt) can also be used.

Additional exemplary nonionic surfactants include, but are not limited to, those having a polyalkylene oxide polymer portion include nonionic surfactants of C6-C24 alcohol ethoxylates (e.g., C6-C14 alcohol ethoxylates) having 1 to about 20 ethylene oxide groups (e.g., about 9 to about 20 ethylene oxide groups); C6-C24 alkylphenol ethoxylates (e.g., C8-C10 alkylphenol ethoxylates) having 1 to about 100 ethylene oxide groups (e.g., about 12 to about 20 ethylene oxide groups); C6-C24 alkylpolyglycosides (e.g., C6-C20 alkylpolyglycosides) having 1 to about 20 glycoside groups (e.g., about 9 to about 20 glycoside groups); C6-C24 fatty acid ester ethoxylates, propoxylates or glycerides; and C4-C24 mono or dialkanolamides.

Exemplary alcohol alkoxylates include, but are not limited to, alcohol ethoxylate propoxylates, alcohol propoxylates, alcohol propoxylate ethoxylate propoxylates, alcohol ethoxylate butoxylates; nonylphenol ethoxylate, polyoxyethylene glycol ethers; and polyalkylene oxide block copolymers including an ethylene oxide/propylene oxide block copolymer such as those commercially available under the trademark PLURONIC (BASF-Wyandotte).

Examples of suitable low foaming nonionic surfactants also include, but are not limited to, secondary ethoxylates, such as those sold under the trade name TERGITOL™, such as TERGITOL™ 15-S-7 (Union Carbide), Tergitol 15-S-3, Tergitol 15-S-9 and the like. Other suitable classes of low foaming nonionic surfactants include alkyl or benzyl-capped polyoxyalkylene derivatives and polyoxyethylene/polyoxypropylene copolymers.

An additional useful nonionic surfactant is nonylphenol having an average of 12 moles of ethylene oxide condensed thereon, it being end capped with a hydrophobic portion including an average of 30 moles of propylene oxide. Silicon-containing defoamers are also well-known and can be employed in the methods of the present invention.

Suitable amphoteric surfactants include, but are not limited to, amine oxide compounds having the formula:

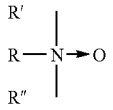

where R, R', R", and R'" are each a $C_1$-$C_{24}$ alkyl, aryl or arylalkyl group that can optionally contain one or more P, O, S or N heteroatoms.

Another class of suitable amphoteric surfactants includes betaine compounds having the formula:

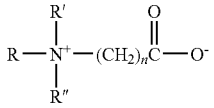

where R, R', R" and R'" are each a $C_1$-$C_{24}$ alkyl, aryl or aralkyl group that can optionally contain one or more P, O, S or N heteroatoms, and n is about 1 to about 10.

Suitable surfactants may also include food grade surfactants, linear alkylbenzene sulfonic acids and their salts, and ethylene oxide/propylene oxide derivatives sold under the Pluronic™ trade name. Suitable surfactants include those that are compatible as an indirect or direct food additive or substance.

Suitable anionic surfactants include, but are not limited to, carboxylates such as alkylcarboxylates (carboxylic acid salts) and polyalkoxycarboxylates, alcohol ethoxylate carboxylates, nonylphenol ethoxylate carboxylates, and the like; sulfonates such as alkylsulfonates, alkylbenzenesulfonates, alkylarylsulfonates, sulfonated fatty acid esters, and the like; sulfates such as sulfated alcohols, sulfated alcohol ethoxylates, sulfated alkylphenols, alkylsulfates, sulfosuccinates, alkylether sulfates, and the like; and phosphate esters such as alkylphosphate esters, and the like. Exemplary anionics include, but are not limited to, sodium alkylarylsulfonate, alpha-olefin sulfonate, and fatty alcohol sulfates. Examples of suitable anionic surfactants include sodium dodecylbenzene sulfonic acid, potassium laureth-7 sulfate, and sodium tetradecenyl sulfonate.

In some embodiments, the surfactant includes linear alkyl benzene sulfonates, alcohol sulfonates, alkyl diphenylether disulfonates, amine oxides, linear and branched alcohol ethoxylates, alkyl polyglucosides, alkyl phenol ethoxylates, polyethylene glycol esters, EO/PO block copolymers and combinations thereof.

The surfactants described herein can be used singly or in combination. In particular, the nonionics and anionics can be used in combination. The semi-polar nonionic, cationic, amphoteric and zwitterionic surfactants can be employed in combination with nonionics or anionics. The above examples are merely specific illustrations of the numerous surfactants which can find application within the scope of this invention. It should be understood that the selection of particular surfactants or combinations of surfactants can be based on a number of factors including compatibility with the surface to be cleaned at the intended use concentration and the intended environmental conditions including temperature and pH.

In addition, the level and degree of foaming under the conditions of use and in subsequent recovery of the composition can be a factor for selecting particular surfactants and mixtures of surfactants.

Cleaning Agent(s)—Chelating/Sequestering/Threshold Agent(s)

In various embodiments of the present invention, the high alkaline-solvent composition of the present invention includes between about 0.1% to about 15% by weight one or more chelating/sequestering/threshold agent(s) to support cleaning and redeposition of soil onto cleaned surfaces. Exemplary commercially available chelating/sequestering agent(s) include, but are not limited to: sodium gluconate (e.g. granular) and sodium tripolyphosphate (available from Innophos); Trilon A® available from BASF; Versene 100®, Low NTA Versene®, Versene Powder®, and Versenol 120® all available from Dow; Dissolvine D-40 available from BASF; and sodium citrate.

In some embodiments, an organic chelating/sequestering agent(s) can be used. Organic chelating/sequestering agent(s) include both polymeric and small molecule chelating/sequestering agent(s). Organic small molecule chelating/sequestering agent(s) are typically organocarboxylate compounds or organophosphate chelating/sequestering agent(s). Polymeric chelating/sequestering agent(s) commonly include polyanionic compositions such as polyacrylic acid compounds. Small molecule organic chelating/sequestering agent(s) include N-hydroxyethylenediaminetriacetic acid (HEDTA), ethylenediaminetetraacetic acid (EDTA), nitrilotriaacetic acid (NTA), diethylenetriaminepentaacetic acid (DTPA), ethylenediaminetetraproprionic acid triethylenetetraaminehexaacetic acid (TTHA), and the respective alkali metal, ammonium and substituted ammonium salts thereof. Aminophosphonates are also suitable for use as chelating/sequestering agent(s) and include ethylenediaminetetramethylene phosphonates, nitrilotrismethylene phosphonates, and diethylenetriamine-(pentamethylene phosphonate) for example. These aminophosphonates commonly contain alkyl or alkenyl groups with less than 8 carbon atoms.

Other suitable chelating/sequestering agent(s) include water soluble polycarboxylate polymers. Such homopolymeric and copolymeric chelating/sequestering agent(s) include polymeric compositions with pendant (—$CO_2H$) carboxylic acid groups and include polyacrylic acid, polymethacrylic acid, polymaleic acid, acrylic acid-methacrylic acid copolymers, acrylic-maleic copolymers, hydrolyzed polyacrylamide, hydrolyzed methacrylamide, hydrolyzed acrylamide-methacrylamide copolymers, hydrolyzed polyacrylonitrile, hydrolyzed polymethacrylonitrile, hydrolyzed acrylonitrile methacrylonitrile copolymers, or mixtures thereof. Water soluble salts or partial salts of these polymers or copolymers such as their respective alkali metal (for example, sodium or potassium) or ammonium salts can also be used. The weight average molecular weight of the polymers is from about 4000 to about 12,000.

In some embodiments, the amount of chelating/sequestering agent(s) present in the composition is about 0.1 wt % to about 15 wt %. In other embodiments, the amount of chelating/sequestering agent(s) present in the composition is about 0.5 wt % to about 5 wt %. In still other embodiments, the amount of chelating/sequestering agent(s) present in the composition is about 0.5% wt % to about 3 wt %.

Thickening Agents

In some embodiments of the present invention, the high alkaline-solvent composition may include between about 0.01% to about 5% by weight one or more thickening agent(s). Thickening agents may be provided to enhance residence time on the substrate surface to be cleaned and assists in keeping the other components together (e.g. the wetting agents and alkaline agents) to further support cleaning Suitable thickening agents include, but are not limited to, natural polysaccharides such as xanthan gum, carrageenan and the like; or cellulosic type thickeners such as carboxymethyl cellulose, and hydroxymethyl-, hydroxyethyl-, and hydroxypropyl cellulose; or, polycarboxylate thickeners such as high molecular weight polyacrylates or carboxyvinyl polymers and copolymers; or, naturally occurring and synthetic clays; and finely divided fumed or precipitated silica, to list a few. The thickening agent can also be used, optionally, to provide emulsifying properties of a given composition (to keep hydrophilic and hydrophobic components of the specific composition from separating) if required for a polymerized zero trans fat soil cleaning method. The emulsifying properties can be used for both a concentrate that can be diluted to create a usable cleaning product (use dilution) and the use dilution itself.

In some embodiments, the thickener(s) are present in the composition at about 0.01 wt % to about 5 wt %. In still yet other embodiments, the thickener is present in the compositions at about 0.1% to about 2 wt %. It is to be understood that all values and ranges between these values and ranges are encompassed by the present invention.

Diluent

The composition of the present invention can be formulated in a concentrated form which then may be diluted to the desired concentration merely with water at the intended use location. Ordinary tap water, softened water or process water may be employed. The composition concentrates and various dilutions of these concentrates (typically can be used at full strength concentrate down to a 1:100 concentrate:water dilution) can be used on a variety of difficult to remove polymerized zero trans fat soils. (A more difficult to remove polymerized zero trans fat soil will generally have a higher level of polymerization.) A variety of mixing methods may be employed (such as automated or manual dilutions) and various levels of additives, such as thickening agents, can be mixed in with the diluted composition depending on the specific needs of the cleaning operation.

EXAMPLES

The present invention is more particularly described in the following examples that are intended as illustrations only. Unless otherwise noted, all parts, percentages, and ratios reported in the following examples are on a weight basis, and all reagents used in the examples were obtained, or are available, from the chemical suppliers described below, or may be synthesized by conventional techniques.

The following Tables 1-8 illustrate exemplary high alkaline-solvent compositions. Tables 2, 4, 6 and 8 illustrate variations that are more suitable for use on soft metal surfaces as they contain an increased level of sodium silicate relative to sodium hydroxide. The higher level of silicate provides greater protection from corrosion in high alkaline environments for soft metal surfaces (such as aluminum). These solutions work well on surfaces where concern for protection against corrosion of soft metal is important. This soft metal safe variation can be used for cleaning of non-stainless steel or other soft metal surfaces.

Table 1 illustrate a basic high alkaline-solvent composition, which includes a solvent system and an alkaline system to provide the main cleaning effect at ambient temperatures as well as at elevated temperatures in addition to a surfactant cleaning agent. Table 2 illustrates the same system as Table 1 with the addition of a silicate source to both enhance cleaning and provide some soft metal corrosion protection. The compositions are emulsified by optimization of components to avoid separation of hydrophilic and hydrophobic components.

TABLE 1

| Alkaline Solvent | |
|---|---|
| Weight % | Ingredient |
| 15 | Benzyl Alcohol |
| 10 | NaOH(50%) |
| 7.5 | Monoethanolamine |
| 2.5 | Dowfax 2A1 |
| 5 | Ethylene Glycol Phenyl Ether |
| 60 | Water |

TABLE 2

| Alkaline Solvent (Soft Metal Safe) | |
|---|---|
| Weight % | Ingredient |
| 15 | Benzyl Alcohol |
| 7.5 | Monoethanolamine |
| 5 | Sodium Silicate Solution, 2.40 $SiO_2/Na_2O$ |
| 1 | Accusol 448 |
| 2.5 | Dowfax 2A1 |
| 5 | Ethylene Glycol Phenyl Ether |
| 2 | NaOH 50% |
| 70 | Water |

The high alkaline-solvent composition can also include peroxide or sulfite additives in order to enhance cleaning performance. Tables 3-4 illustrate compositions that include sulfite and Tables 5-6 illustrate compositions that include hydrogen peroxide and a catalyst that permits the alkaline hydrogen peroxide to react with polymerized zero trans fat soil at ambient temperatures, both of which enhance removal of polymerized zero trans fat soils during cleaning. The compositions are emulsified by optimization of components to avoid separation of hydrophilic and hydrophobic components.

TABLE 3

| Alkaline-Sulfite Solvent | |
|---|---|
| Weight % | Ingredient |
| 15 | Benzyl alcohol |
| 10 | NaOH(50%) |
| 7.5 | Monoethanolamine |
| 2.5 | Dowfax 2A1 |
| 5 | Ethylene Glycol Phenyl Ether |
| 59.8 | Water |
| 0.2 | Sodium Sulfite |

TABLE 4

| Alkaline-Sulfite Solvent (Soft Metal Safe) | |
|---|---|
| Weight % | Ingredient |
| 15 | Benzyl Alcohol |
| 7.5 | Monoethanolamine |
| 2.5 | Dowfax 2A1 |
| 5 | Ethylene Glycol Phenyl Ether |
| 0.2 | Sodium Sulfite |
| 69.8 | Water |

TABLE 5

| Peroxy-Alkaline Solvent | |
|---|---|
| Weight % | Ingredient |
| 15 | Benzyl Alcohol |
| 10 | NaOH(50%) |
| 7.5 | Monoethanolamine |
| 2.5 | Dowfax 2A1 |
| 5 | Ethylene Glycol Phenyl Ether |
| 59.49 | Water |
| 0.5 | Hydrogen Peroxide 30% |
| 0.01 | $MnSO_4$ |

TABLE 6

| Peroxy-Alkaline Solvent (Soft Metal Safe) | |
|---|---|
| Weight % | Ingredient |
| 15 | Benzyl Alcohol |
| 10 | NaOH(50%) |
| 7.5 | $SiO_2/Na_2O$ |
| 2.5 | Dowfax 2A1 |
| 5 | Ethylene Glycol Phenyl Ether |
| 59.49 | Water |
| 0.5 | Hydrogen Peroxide 30% |
| 0.01 | $MnSO_4$ |

Finally, the high alkaline-solvent composition can include a thickener or gelling agent, so that the composition can remain in place on inclined or vertical surfaces for extended time periods without significantly drying out. Tables 7-8 illustrate compositions that include a thickener which enhances residence time. The compositions are emulsified by optimization of components to avoid separation of hydrophilic and hydrophobic components.

TABLE 7

| Gelled Alkaline Solvent | |
|---|---|
| Weight % | Ingredient |
| 15 | Benzyl Alcohol |
| 10 | NaOH(50%) |
| 7.5 | Monoethanolamine |
| 2.5 | Dowfax 2A1 |
| 5 | Ethylene Glycol Phenyl Ether |
| 59.8 | Water |
| 0.2 | Xanthan Gum |

TABLE 8

| Gelled Alkaline Solvent (Soft Metal Safe) | |
|---|---|
| Weight % | Ingredient |
| 15 | Benzyl Alcohol |
| 7.5 | Monoethanolamine |
| 2.5 | Dowfax 2A1 |
| 5 | Ethylene Glycol Phenyl Ether |
| 69.8 | Water |
| 0.2 | Xanthan Gum |

Methods:

In another embodiment, the present invention is a method for cleaning polymerized zero trans fat soils. The cleaning methods generally use the high alkaline-solvent compositions described above. In certain embodiments, an environmental cleaning method is provided. In other embodiments, a clean in place (CIP) method is provided. Of course, the high alkaline-solvent compositions can be used in any other methods seeking to remove polymerized zero trans fat soils.

Environmental Cleaning Method

An environmental cleaning method is provided. This method is adapted for removing normal trans fat soils from environmental surfaces, which include, but are not limited to walls, floors, dishes, flatware, pots and pans, ovens and fryers. This method generally involves contacting an environmental surface with an above-described high alkaline-solvent composition. In certain cases, the environmental method includes a step of heating the high alkaline-solvent composition to a temperature of about 40° F. or above. In various embodiments of the present invention, the method includes a step of cleaning with the high alkaline-solvent composition at a temperature of about 40° F. to about 130° F. In other cases the environmental methods provide for soil removal from surfaces at an ambient or room temperature, e.g., about 50° F. to about 100° F. In other cases, methods provide for soil removal from surfaces at colder temperature, e.g., about 25° F. to about 50° F. In other cases, the methods may require applying the high alkaline-solvent composition to environmental surfaces that range in temperature from 0° F. to about 200° F. which may exist in close proximity within a facility to be cleaned (for example fats condensing on freezer surfaces or hot external oven surfaces respectively). Again, in general, the high alkaline-solvent based compositions of the types described above tend to show increased beneficial cleaning characteristics with increasing temperature when applied to surfaces contaminated with difficult polymerized zero trans fat soils. Whereas, the high alkaline-solvent compositions do not need to be heated to remove less difficult polymerized zero trans fat soils (soils that have a lower level of polymerization due to less time to polymerize or under lower temperature conditions during polymerization). In some embodiments the environmental method includes contacting an environmental surface with the high alkaline-solvent composition for a sufficient amount of time such that the composition penetrates into the soil to be removed. The length of time required for soil penetration will depend on the thickness of the soil as well as the relative polymerization level of the soil. In such cases, it is preferable that the high alkaline-solvent composition includes a high foaming surfactant system or a thickening system so that the composition does not dry out and remains hydrated on the surface for an extended period of time.

CIP Method

In another embodiment, the present invention is a CIP method. This method is adapted for removing polymerized zero trans fat soils from internal components of tanks, lines, pumps and other process equipment used for processing typically liquid product streams, including zero trans fat streams in addition to external surfaces of such equipment that can be cleaned in an automated fashion in an enclosed area. This method generally involves passing an above-described high alkaline-solvent composition through a processing system without dismantling any system components and then resuming normal processing. The high alkaline-solvent composition can be used in any known CIP method. In some cases, the method includes passing the following liquids through a processing system: a first rinse, a cleaning cycle using the high alkaline-solvent composition herein described; a second rinse and, possibly, a neutralizing or sanitizing rinse and, possibly, a final rinse. The first rinse can include another cleaning composition or hot or cold water. The second rinse often includes hot or cold water and is used to remove the cleaning composition and residual soil. An additional rinse may be used to neutralize or sanitize the equipment being cleaned which may or may not require a final rinse to remove residual neutralizing or final rinse and is often skipped in order to prevent contamination of the equipment with bacteria following the cleaning In certain cases, the CIP method includes a step of heating the high alkaline-solvent composition to a temperature of about 100° F. or above. In various embodiments of the present invention, the method includes a step of heating the high alkaline-solvent composition to a temperature of about 100° F. to about 200° F. In still other embodiments of the present invention, the method includes a step of heating the high alkaline-solvent composition to a temperature of about 105° F. to about 160° F. High alkaline-solvent compositions heated to these temperatures show improved cleaning characteristics of difficult polymerized zero trans fat soils.

The CIP methods can be used to clean a wide variety of processing equipment, including, but not limited to fryers, various freezer or refrigerated systems, evaporators, heat exchangers (including tube-in-tube exchangers, direct steam injection, and plate-in-frame exchangers), heating oils (including steam, flame or heat transfer fluid heated) re-crystallizers, pan crystallizers, spray dryers, drum dryers, and tanks In addition, CIP cleaning methods can be used to clean environmental areas including, but not limited to entire areas containing food processing equipment and associated walls, ceilings, floors in addition to duct work (external and internal) as well as other air handling systems.

The present methods can also be used to remove soils other than polymerized zero trans fat soils. Such other soils include, but are not limited to, starch, cellulosic fiber, protein, simple carbohydrates and combinations of any of these soil types with mineral complexes. Examples of specific food soils that are effectively removed using the present methods include, but are not limited to, soils generated in the manufacture and processing meat, poultry, vegetables and fruit, bakery goods, soft drinks, brewing and fermentation residues, soils generated in sugar beet and cane processing and processed foods containing these ingredients and associated ingredients such as juices, sauces and condiments (e.g., fruit juices, ketchup, tomato sauce, barbeque sauce). These soils can develop on environmental surfaces such as walls and floors, freezers and cooling systems, heat exchange equipment surfaces, conveyor surfaces and on other surfaces during the manufacturing and packaging process.

Exemplary industries in which the present methods can be used include, but are not limited to: the food and beverage industry; oil processing industry; industrial agriculture and ethanol processing; and the pharmaceutical manufacturing industry.

EXAMPLES

The present invention is more particularly described in the following examples that are intended as illustrations only.

Example 1

Cleaning Efficacy Screening Test

This experiment was run to determine the relative efficacy of cleaning factory produced polymerized zero trans fat soils using exemplary compositions. For this test, a production facility polymerized zero trans fat soil was used.

Production Facility Polymerized Zero Trans Fat Soil Cleaning Test

In this test, brownish red soils from a hood duct that collected zero trans fat mist during frying operations were removed. The soil was then cut into 3 mm sized cubes. This soil was representative of worst case field soils created by zero trans fat mists over a long period of time (>3 weeks). In addition, reddish-brown soils from a fryer surface were removed and cut into 3 mm sized cubes. This soil was representative of worst case field soils created by zero trans fat polymerized onto hot surfaces over a long period of time (>3 weeks).

Each sample was used in a Production Facility Polymerized Zero Trans Fat Soil Cleaning Test to screen high alkaline-solvent cleaning compositions at room temperature and in a hot water bath set at desired temperatures below 200° F. A sample of one of each soil was placed in a 20 ml vial with 5 ml of a high alkaline-solvent cleaning composition.

Results

Table 9 illustrates the relative efficacy of cleaning factory produced polymerized zero trans fat soils using a basic alkaline-solvent composition, which includes a solvent system and an alkaline system to provide the main cleaning effect at ambient temperatures as well as at elevated temperatures in addition to a surfactant cleaning agent. Table 10 illustrates the same system as Table 9 with the addition of a silicate source to both enhance cleaning and provide some soft metal corrosion protection.

TABLE 9

| Alkaline Solvent | | |
|---|---|---|
| Field Soil Temp | Alk-Sol Dissolution Rating | Alk Dissolution Rating |
| 170 F. | 8 | 4 |
| 72 F. | 7 | 2.5 |

TABLE 10

| Alkaline Solvent (Soft Metal Safe) | | |
|---|---|---|
| Field Soil Temp | Alk-Sol-Sil Dissolution Rating | Alk-Sil Dissolution Rating |
| 170 F. | 2.5 | 2.5 |
| 72 F. | 3 | 2 |

The high alkaline-solvent composition can also include sulfite or peroxide additives in order to enhance cleaning performance. Tables 11 and 12 illustrate the relative efficacy of cleaning factory produced polymerized zero trans fat soils using a sulfite composition and Tables 13 and 14 illustrate compositions that include hydrogen peroxide and a catalyst that permits the alkaline hydrogen peroxide to react with polymerized zero trans fat soils during cleaning.

TABLE 11

| Alkaline-Sulfite Solvent | | |
|---|---|---|
| Field Soil Temp | Alk-Sol Sulfite Dissolution Rating | Alk-Sulfite Dissolution Rating |
| 170 F. | 7 | 5 |
| 72 F. | 7 | 3 |

TABLE 12

| Alkaline-Sulfite Solvent (Soft Metal Safe) | | |
|---|---|---|
| Field Soil Temp | Alk-Sol-Sil Sulfite Dissolution Rating | Alk-Sil Sulfite Dissolution Rating |
| 170 F. | 3 | 3 |
| 72 F. | 3 | 2.5 |

TABLE 13

| Peroxy-Alkaline Solvent | | |
|---|---|---|
| Field Soil Temp | Alk-Sol H2O2 Dissolution Rating | Alk H2O2 Dissolution Rating |
| 170 F. | 8 | 5 |
| 72 F. | 7.5 | 3.5 |

TABLE 14

| Peroxy-Alkaline Solvent (Soft Metal Safe) | | |
|---|---|---|
| Field Soil Temp | Alk-Sol-Sil H2O2 Dissolution Rating | Alk-Sil H2O2 Dissolution Rating |
| 170 F. | 3 | 3 |
| 72 F. | 2.5 | 2.5 |

Finally, the high alkaline-solvent composition can include a thickener or gelling agent, so that the composition can remain in place on inclined or vertical surfaces for extended time periods without significantly drying out. Tables 15 and 16 illustrate the relative efficacy of cleaning factory produced polymerized zero trans fat soils using a composition that includes a thickener which enhances residence time.

TABLE 15

| Gelled Alkaline Solvent | | |
|---|---|---|
| Field Soil Temp | Alk-Sol Gel Dissolution Rating | Alk-Gel Dissolution Rating |
| 170 F. | 8 | 3.5 |
| 72 F. | 7.5 | 3 |

TABLE 16

| Gelled Alkaline Solvent (Soft Metal Safe) | | |
|---|---|---|
| Field Soil Temp | Alk-Sol-Sil Gel Dissolution Rating | Alk-Sil Gel Dissolution Rating |
| 170 F. | 3 | 3 |
| 72 F. | 2.5 | 2 |

Example 2

Quantitative Cleaning Test

This experiment was run to determine the relative efficacy of cleaning laboratory prepared polymerized zero trans fat soils using exemplary compositions. For this test, a laboratory polymerized zero trans fat soil was created.

Laboratory Polymerized Zero Trans Fat Soil

First, 0.5 g of corn oil was placed on a coupon and then the coupon was heated on a hot plate at 390° F. until the oil became a solid, dark, reddish brown coating. The weight of the soil was determined by subtracting the initial weight of the coupon from the weight of the coupon plus the soil. This soil could be removed by scratching with a fingernail but not with 200° F. water.

Results

Table 17 illustrates the relative efficacy of laboratory polymerized zero trans fat soils using a basic alkaline-solvent composition, which includes a solvent system and an alkaline system to provide the main cleaning effect at ambient temperatures as well as at elevated temperatures in addition to a surfactant cleaning agent. Table 18 illustrates the same system as Table 9 with the addition of a silicate source to both enhance cleaning and provide some soft metal corrosion protection.

TABLE 17

| Alkaline Solvent | | |
|---|---|---|
| Lab Soil Temp | Alk-Sol % Removal | Alk % Removal |
| 170 F. | 89 | 38 |
| 72 F. | 100 | 26 |

TABLE 18

| Alkaline Solvent (Soft Metal Safe) | | |
|---|---|---|
| Lab Soil Temp | Alk-Sol-Sil % Removal | Alk-Sil % Removal |
| 170 F. | 54 | NA |
| 72 F. | 33 | NA |

The high alkaline-solvent composition can also include sulfite or peroxide additives in order to enhance cleaning performance. Tables 19 and 20 illustrate the relative efficacy of laboratory polymerized zero trans fat soils using a sulfite composition and Tables 21 and 22 illustrate compositions that include hydrogen peroxide and a catalyst that permits the alkaline hydrogen peroxide to react with polymerized zero trans fat soils during cleaning

TABLE 19

| Sulfite Solvent | | |
|---|---|---|
| Lab Soil Temp | Alk-Sol Sulfite % Removal | Alk-Sulfite % Removal |
| 170 F. | 77 | 58 |
| 72 F. | 100 | 28 |

TABLE 20

| Sulfite Solvent (Soft Metal Safe) | | |
|---|---|---|
| Lab Soil Temp | Alk-Sol-Sil Sulfite % Removal | Alk-Sil Sulfite % Removal |
| 170 F. | 45 | NA |
| 72 F. | 37 | NA |

TABLE 21

| Peroxy-Alkaline Solvent | | |
|---|---|---|
| Lab Soil Temp | Alk-Sol-H2O2 % Removal | Alk-H2O2 % Removal |
| 170 F. | 77 | 58 |
| 72 F. | 100 | 45 |

TABLE 22

| Peroxy-Alkaline Solvent (Soft Metal Safe) | | |
|---|---|---|
| Lab Soil Temp | Alk-Sol-Sil H2O2 % Removal | Alk-Sil H2O2 % Removal |
| 170 F. | 42 | NA |
| 72 F. | 39 | NA |

Finally, the high alkaline-solvent composition can include a thickener or gelling agent, so that the composition can remain in place on inclined or vertical surfaces for extended time periods without significantly drying out. Tables 23 and 24 illustrate the relative efficacy of laboratory polymerized zero trans fat soils using a composition that includes a thickener which enhances residence time.

TABLE 23

| Gelled Alkaline Solvent | | |
|---|---|---|
| Lab Soil Temp | Alk-Sol-Gel % Removal | Alk-Gel % Removal |
| 170 F. | 77 | 51 |
| 72 F. | 100 | 28 |

TABLE 24

| Gelled Alkaline Solvent (Soft Metal Safe) | | |
|---|---|---|
| Lab Soil Temp | Alk-Sol-Sil Gel % Removal | Alk-Sil Gel % Removal |
| 170 F. | 31 | NA |
| 72 F. | 29 | NA |

It is to be understood that while the invention has been described in conjunction with the detailed description thereof, the foregoing description is intended to illustrate, and not limit the scope of the invention, which is defined by the scope of the appended claims. Other aspects, advantages, and modifications are within the scope of the following claims.

It is to be understood that wherever values and ranges are provided herein, all values and ranges encompassed by these values and ranges, are meant to be encompassed within the scope of the present invention. Moreover, all values that fall within these ranges, as well as the upper or lower limits of a range of values, are also contemplated by the present application.

We claim:

1. A composition for removing zero trans fat soil comprising:

(i) about 0.1 wt. % to about 50 wt. % soil wetting solvent system comprising at least a first and second soil wetting solvent, wherein the first solvent is an aromatic alcohol selected from the group consisting of benzyl alcohol, methyl benzyl alcohol, alpha phenyl ethanol and mixtures thereof, and wherein the second solvent is selected from the group consisting of an aliphatic alcohol, glycol ether, alkanol amine, ether amine, ester, dialkyl carbonate and mixtures thereof;

(ii) about 0.1 wt. % to about 75 wt. % alkaline wetting and saponifying agent;

(iii) about 0.01 wt. % to about 40 wt. % one or more cleaning agent(s); and (iv) about 0.01 wt. % to about 5 wt. % one or more additive(s) to modify the composition; and wherein the composition is emulsified at a usable cleaning solution concentration or in a concentrated form that can be diluted to a usable cleaning solution concentration; and further wherein the ratio of the first solvent to the second solvent of the soil wetting solvent system is 3:1.

2. The composition of claim 1, wherein the second solvent of the soil wetting solvent system is selected from the group consisting of ethylene glycol monobutyl ether, diethylene glycol monobutyl ether, ethylene glycol phenyl ether, propylene glycol phenyl ether and combinations thereof.

3. The composition of claim 1, wherein the alkaline wetting and saponifying agent(s) is selected from the group consisting of alkali or alkaline earth metal hydroxides, silicate salts, amines, alkanol amines, phosphate salts, polyphosphate salts, carbonate salts, borate salts, and combinations thereof.

4. The composition of claim 3, wherein the alkaline wetting agent is selected from the group consisting of sodium hydroxide, potassium hydroxide, sodium silicate, sodium metasilicate, sodium orthosilicate, potassium silicate, potassium metasilicate, potassium orthosilicate and combinations thereof.

5. The composition of claim 1, wherein the second solvent of the soil wetting solvent system is selected from the group consisting of monoethanolamine, diethanolamine, triethanolamine, mixed isopropanolamines, morpholine, n,n-dimethyl ethanolamine, and combinations thereof.

6. The composition of claim 1, wherein the cleaning agent(s) is selected from the group consisting of anionic, nonionic, cationic, and zwitterionic surfactants.

7. The composition of claim 6, wherein the cleaning agent(s) is selected from the group consisting of alkyl diphenylether disulfonate, a dimethyl or ethyl alkyl amine oxide, an n-alkyl dimethyl benzyl ammonium chloride, an alkyl polyglycoside in which the alkyl group contains 8-18 carbon atoms and combinations thereof.

8. The composition of claim 1, wherein the additive is a thickening agent.

9. The composition of claim 8, wherein the thickening agent is xantham gum.

10. The composition of claim 1, wherein the composition is used to clean a soiled surface selected from the group consisting of food processing equipment and environmental surfaces such as walls, floors and miscellaneous equipment used during food production.

11. The composition of claim 1, wherein the composition is applied to the soiled surface to be cleaned for an amount of time sufficient to substantially penetrate a polymerized zero trans fat soil, preferably between about 30 seconds and about 24 hours depending on the level of polymerization.

* * * * *